US006536172B1

(12) United States Patent
Amend

(10) Patent No.: US 6,536,172 B1
(45) Date of Patent: Mar. 25, 2003

(54) INSULATING CONSTRUCTION FORM AND MANNER OF EMPLOYMENT FOR SAME

(76) Inventor: Victor A. Amend, 116 Newton Drive, Toronto, Ontario (CA), M2M 2N1

( * ) Notice: Subject to any disclaimer, the term of this patent is extended or adjusted under 35 U.S.C. 154(b) by 0 days.

(21) Appl. No.: 09/323,013

(22) Filed: Jun. 1, 1999

(51) Int. Cl.[7] ..... E04G 17/06; E04B 2/86

(52) U.S. Cl. ..... 52/426; 52/98; 52/309.12; 52/431; 52/432; 52/592.3; 52/592.6; 52/606; 52/677; 52/309.17; 249/213; 249/214; 249/216

(58) Field of Search ..... 52/98, 105, 426, 52/431, 505, 592.6, 604, 606, 677, 712, 592.3, 715, 309.12, 309.17, 424, 425, 432; 249/213, 214, 216

(56) References Cited

U.S. PATENT DOCUMENTS

| | | | | | |
|---|---|---|---|---|---|
| 1,784,329 | A | * | 12/1930 | Bierhaalder | 249/213 X |
| 4,085,559 | A | * | 4/1978 | Ilukowicz | 52/687 |
| 4,439,967 | A | * | 4/1984 | Dielenberg | 52/309.12 |
| 4,604,843 | A | * | 8/1986 | Ott et al. | 52/426 |
| 4,706,429 | A | | 11/1987 | Young | |
| 4,731,968 | A | * | 3/1988 | Obino | 52/426 X |
| 4,866,891 | A | * | 9/1989 | Young | 52/105 |
| 4,884,382 | A | * | 12/1989 | Horobin | 52/426 |
| 4,885,888 | A | | 12/1989 | Young | |
| 5,086,600 | A | * | 2/1992 | Holland et al. | 52/426 X |
| 5,390,549 | A | | 2/1995 | Mensen | |
| 5,428,933 | A | * | 7/1995 | Philppe | 52/309.12 X |
| 5,465,542 | A | | 11/1995 | Terry | |
| 5,598,675 | A | | 2/1997 | Pruss | |
| 5,625,989 | A | * | 5/1997 | Brubaker et al. | 52/309.12 |
| 5,704,180 | A | * | 1/1998 | Boeck | 52/309.12 X |
| 5,809,727 | A | | 9/1998 | Mensen | |
| 5,845,449 | A | * | 12/1998 | Vaughan et al. | 52/309.12 X |
| 5,852,907 | A | * | 12/1998 | Tobin et al. | 52/714 |
| 5,855,102 | A | * | 1/1999 | Chang | 52/604 |
| 5,896,714 | A | | 4/1999 | Cymbala | |
| 6,240,693 | B1 | * | 6/2001 | Komasara et al. | 52/439 |
| 6,308,484 | B1 | * | 10/2001 | Severino | 52/426 |
| 6,324,804 | B1 | * | 12/2001 | Hoogstraten | 52/426 |

FOREIGN PATENT DOCUMENTS

| | | | | |
|---|---|---|---|---|
| DE | 2440200 | * | 3/1976 | 52/677 |
| DE | 29919379 | | 1/2000 | |
| FR | 2694957 | | 2/1994 | |
| GB | 986450 | * | 2/1964 | 52/677 |
| WO | WO 9701007 | | 1/1997 | |

* cited by examiner

*Primary Examiner*—Laura A. Callo
(74) *Attorney, Agent, or Firm*—John R. S. Orange; Orange & Chari

(57) ABSTRACT

An insulating construction form consisting of a pair of spaced apart panels and a plurality of ties is applied to the building of structural walls. The tie members include pairs of resilient retainer arms, which define a series of adjacent receptacles. A reinforcing bar is typically inserted into the receptacles and its displacement therefrom is inhibited by abutment surfaces. Markings are positioned on each panel to guide the attachment of a cladding. In one aspect, the construction form serves for the formation of a corner, wherein a vertical rod is positioned for the attachment of the cladding. In another aspect, the panels includ a plurality of openings made at the time of manufacture.

42 Claims, 8 Drawing Sheets

SECTION A–A

SECTION A–A

SIDE VIEW

FRONT VIEW

INSULATING CONSTRUCTION FORM AND MANNER OF EMPLOYMENT FOR SAME

BACKGROUND OF THE INVENTION

The present invention relates to an insulating construction form for the building of structural walls. Construction forms are employed to act as a mold for a poured concrete charge in making walls of the like. Typically, the forms comprise a pair of spaced panels that define an outer surface of the walls and the forms are intended to be removed once the concrete is set. More recently, consideration has been given to thermal properties of the walls and the need to incorporate thermal insulation in the walls.

Many variations on the design of a construction form for insulated walls have been disclosed in the art. Prior art design of construction forms is exemplified by U.S. Pat. Nos. 4,706,429, 5,598,675, and 5,390,459, all of which include a pair of high density foam panels spaced apart by a series of bridging ties. A reinforcing bar, or rebar, is positioned between the panels and is supported by the ties. The ties comprise a pair of endplates connected by a web, and are typically made of an insulating material such as plastic in order to inhibit thermal bridging between the panels.

Young, in U.S. Pat. No. 4,706,429, teaches the employment of an interconnecting mechanism consisting of a series of projections and corresponding recesses on a top and a bottom surface of the panels. When the construction forms are stacked in vertical layers, the interlocking projections and corresponding recesses provide a concrete impervious seam during charging. One inadequacy of the current interconnect design is that the stacked layers can separate during charging due to hydrodynamic forces of the concrete, and also during stacking of the constructions forms in windy conditions.

Mensen, in U.S. Pat. No. 5,390,459, and Pruss, in U.S. Pat. No. 5,598,675, both teach the deployment of adjacent receptacles at the top of the tie, defined by a series of arms, for the positioning of the rebar. Multiple receptacles are required for rebar positioning, since rebar is frequently curved along its length due to handling. The rebar may therefore be misaligned with an inline series of receptacles, positioned longitudinally along the construction form. In certain instances, a number of arms must be removed to accommodate for misalignment of the rebar. Pruss teaches detachable arms but their removal may tear the web, which can result in cracking of the web during charging. Mensen's arms cannot be removed as they are integral with the web.

Both Mensen and Pruss disclose arms with hooks framing the receptacle on either side, to help retain the rebar in position during charging. The inclusion of this retention feature permits a limited number of rebar sizes to be used with any one size of receptacle, due to the rigidity of the arms. Removal of any of Pruss' retaining arms between the receptacles, results in an oversized receptacle which is detrimental to the retaining feature and may result in the loss thereof. When the retaining feature of the arms is absent, the rebar is not held as securely and therefore may shift during charging.

There are many designs in the prior art, where the insulating construction form serves for a formation of a corner, typically 90°. Typically the endplates of the ties provide the retention for fasteners, but traditional placement of the ties in the prior art results in the corner region of a construction form being devoid of any internal supports, to which a cladding such as drywall and exterior siding can be secured.

It is therefore an objective of the present invention to provide an insulating construction form that will obviate or mitigate the above disadvantages.

SUMMARY OF THE INVENTION

In one aspect of the invention, there is provided an insulating construction form comprising a pair of panels made of an insulating material arranged in a spaced parallel relationship with their inner surfaces facing each other, and a number of bridging ties extending between and embedded in the panels. Each of the panels include an inside surface and an outside surface, a top surface and a bottom surface. Each of the ties comprises a pair of elongated end plates that are integral with at least one web, which extends between and is connected to the end plates. Each of the end plates may be embedded between the inside and outside surfaces of each of the panels. The webs include at least one retainer arm located along the web. Each of the receptacles include a pair of retainer arms for locating and retaining a reinforcing bar between the arms.

Located at the top of each arm is a hooked barb which is angled, in a downward and inward orientation towards the interior of the corresponding receptacle. A spine may be attached to the back of the arm, disposed perpendicular therefrom. The barbs, along with the resilient nature of the arms, help to provide a snap fit for the reinforcing bar when positioned in the receptacle. This snap fit inhibits movement of the reinforcing bar out of the receptacle during installation and subsequent pouring of the charge. Attached to the side of the web may be a series of guides, which can assist in positioning of the ties in a mold during formation of the panels. A plurality of ridges may also be located on the side of the web to stiffen the web.

In a further aspect, the retaining function of the barbs is accomplished by abutment surfaces, preferably located at the end of the retaining arms and arcuate shaped.

In employment of the construction form, a plurality of forms are stacked in layers in an overlapping manner to form a wall. In another aspect of the invention the top surface and the bottom surface of the panels include an interconnecting mechanism comprising a plurality of projections and a plurality of corresponding recesses. The insertion of the projections into the corresponding recesses provides an interference fit between adjacent forms stacked in a vertical manner, in order to inhibit separation of the forms during installation such as in windy conditions or during charging.

A further aspect of the retainer arms is the inclusion of a weakening notch, in the preferred embodiment, which allows arms to be easily removed from the web in order to accommodate an irregularly shaped reinforcing bar, without excessive damage to the body of the web.

Once construction of the wall is completed the charge, typically concrete or other suitable building materials may be poured into the interior and allowed to set, thereby producing an insulated structural wall. A plurality of markings on the exterior surface of the construction form may be used to guide the location of fasteners, such as screws or nails. The fasteners are used to attach a cladding such as drywall or metal siding, to the end plates preferably embedded in the panels.

In a further aspect of the invention, at least one of the panels is divided into a first portion and a second portion disposed at angle to define a corner. The corner has a substantially vertical duct extended between the top and the bottom surfaces of the panel located preferably adjacent to the apex of the corner. A solid or hollow rod may be inserted into the duct. The rod provides an anchor in the interior of the panel for the attachment of the exterior cladding in the corner region.

Frictional grip between the side walls of the duct and the rod also helps to create an integral vertical formation during installation of the layered construction forms and subsequent charging. The rod can be made of any suitable material, such as wood, metal or plastic.

In another aspect of the invention, a method of molding an insulating form comprising the steps of formation of a pair of panels made of an insulating material and having an inside surface and an outside surface, a top surface and a bottom surface. The panels are arranged in a spaced parallel relationship with their inner surfaces facing each other. Provided in at least one of the panels is a plurality of apertures, each of which extends between the inside and outside surfaces of the panel. The panels are connected by at least two bridging ties extending between the panels. The connection includes embedding a pair of end plates integrally formed with at least one web in the panels, wherein each of the end plates is located between the inside and the outside surfaces of each of the panels. The method of molding the panels includes the step of forming the apertures at the time molding the panels and an interior surface of the apertures may be lined with a liner, made of a suitably rigid material, such as plastic or metal.

BRIEF DESCRIPTION OF THE DRAWINGS

These and other features of the preferred embodiments of the invention will become more apparent in the following detailed description, in which reference is made to the appended drawings by way of example only.

DESCRIPTION OF THE PREFERRED EMBODIMENTS

Figure 1:
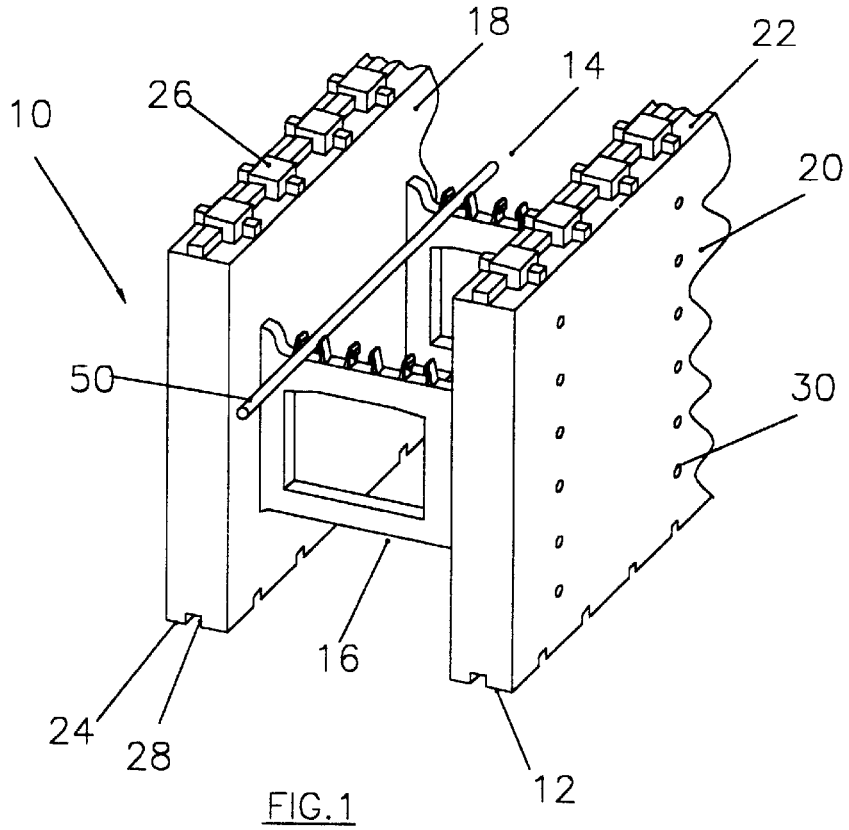
FIG. 1 is a perspective view of an insulating concrete form.
Figure 2:
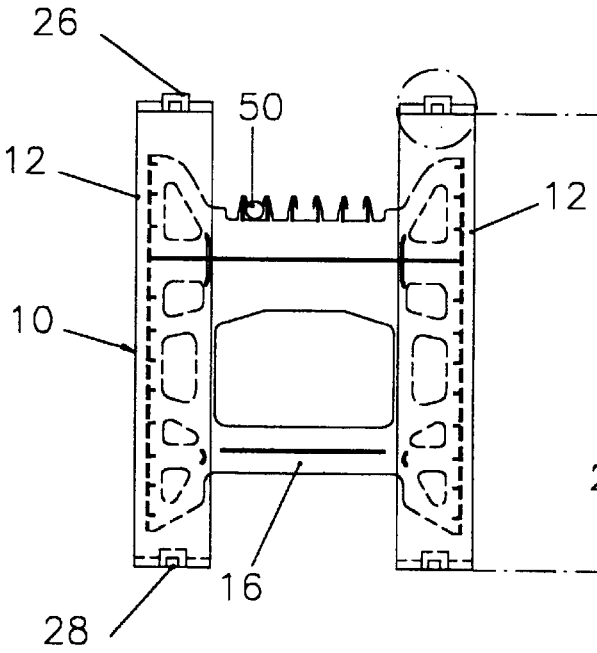
FIG. 2 is an end view of the form shown in FIG. 1.

Referring to FIGS. 1 and 2, an insulating construction form 10 includes a pair of panels 12 of rectangular cross section, maintained in a spaced parallel relationship by a plurality of ties 16, to define a chargeable interior 14. The ties 16 support a reinforcing bar 50 that extends longitudinally within the interior at selected locations. Each panel 12 includes an inside 18 surface and an outside 20 surface, interconnected by a top 22 surface and a bottom 24 surface. A plurality of projections 26 are formed on the top 22 surface, and a plurality of corresponding recesses 28 on each bottom 24 surface. A plurality of markings 30, in the form of raised projections or indentations, are positioned on the outside surface 20 of each panel 12. The corresponding locations of each of the interior ties 16, that are positioned at regular spaced intervals along and between the panels 12, are thus indicated to a user of the concrete form 10.

Figure 5:
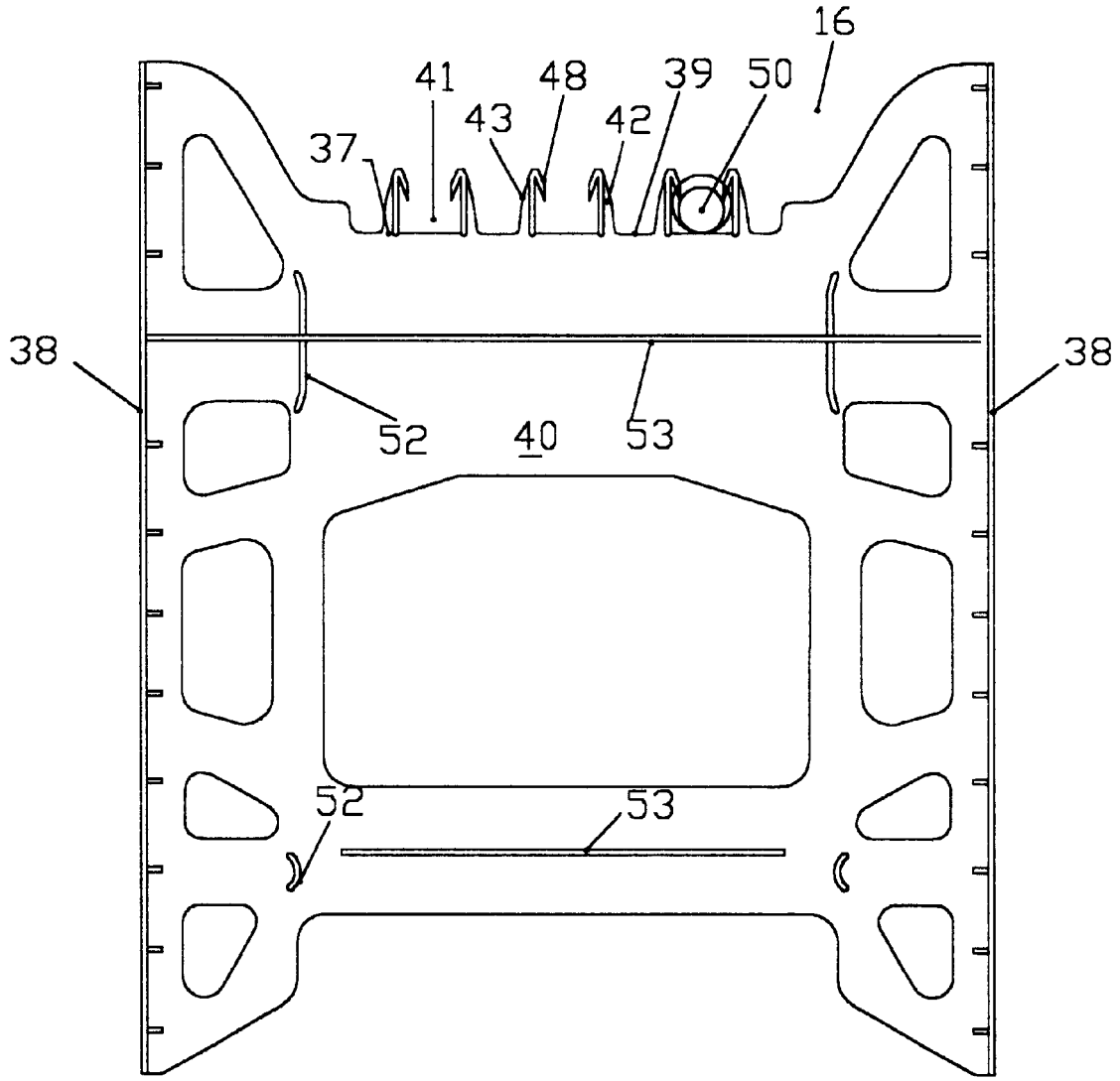
FIG. 5 is view of a tie.

Each of the ties 16 shown in FIG. 5, include a pair of end plates 38 and a web 40 extending between and connected at either end to the endplates 38. Six resilient retainer arms 42 are attached to a top 39 of the web 40, arranged in three pairs spaced apart along the top 39. Each pair of retainer arms 42, and the top 39 therebetween, defines a receptacle 41. Located at the top of each retainer arm 42 is a barb 48, which is angled, in a downward and inward orientation towards the interior of the corresponding receptacle 41. The orientation of the barbs 48 accommodate the installation of the rebar 50, in the corresponding receptacle 41, but inhibit its removal. The rebar 50 cannot easily be removed from the receptacle 41 once inserted unless the interfering barbs 48 are broken away from the arms 42.

A spine 43 is attached to the back of each of the retainer arms 42 and lies in the plane of the web 40 to increase the bending stiffness of the arms 42. Flexure of the barbs 48 provide a snap fit for the reinforcing bar 50 when positioned in the receptacle 41, and inhibit movement of the reinforcing bar 50 out of the receptacle 41.

Attached to the side of the web 40 are guides 52, which assist in positioning of the ties 16 in a mold (not shown) during formation of the panels 12. A ridge 53 is located on a side face of the web 40 to increase stiffness and apertures 54 are provided along each edge to enhance retention of the tie 16 in the panels 12.

The panels 12 are formed from a foamed plastics material, typically a polystyrene and the ties 16 are molded from a compatible plastics material. To provide an integral form 10, the end plates 38 and a portion of the web 40 are encased in the interior of each corresponding panel 12, as they are molded. This arrangement produces an integral connection between the panels 12 and the ties 16 as shown in FIG. 1. The details of molding of panels 12 are well known in the art and therefore will not be described further.

Figure 3:
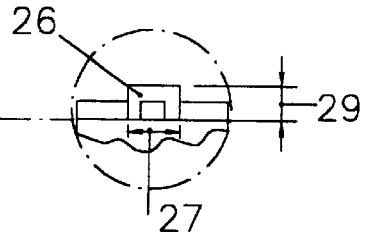
FIG. 3 is an enlarged view of a portion of the form's upper surface shown in FIG. 2.
Figure 4:
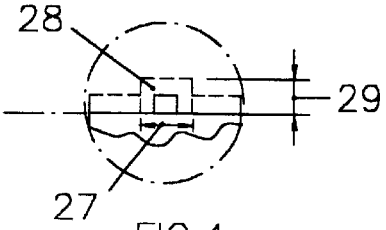
FIG. 4 is an enlarged view of a portion of the form's lower surface shown in FIG. 2.

Preferably the form 10 and tie 16 material are selected to fuse to one another to enhance retention, although mechanical connection can also be used if desired. The projections 26 and the corresponding recesses 28 are shown in greater detail in FIGS. 3 and 4. The width 27 of each of the projections 26 is slightly larger than that of each of the corresponding recesses 28. The height 29 of each projection 26 is smaller than that of each of the corresponding recesses 28, in order to make the volume of each of the projections 26 equal to or less than that of each of the recesses 28. An interference fit is thus provided between vertically adjacent construction forms 10, whereby undesirable separation of the layers is inhibited during installation such as in windy conditions or during charging.

Figure 6:
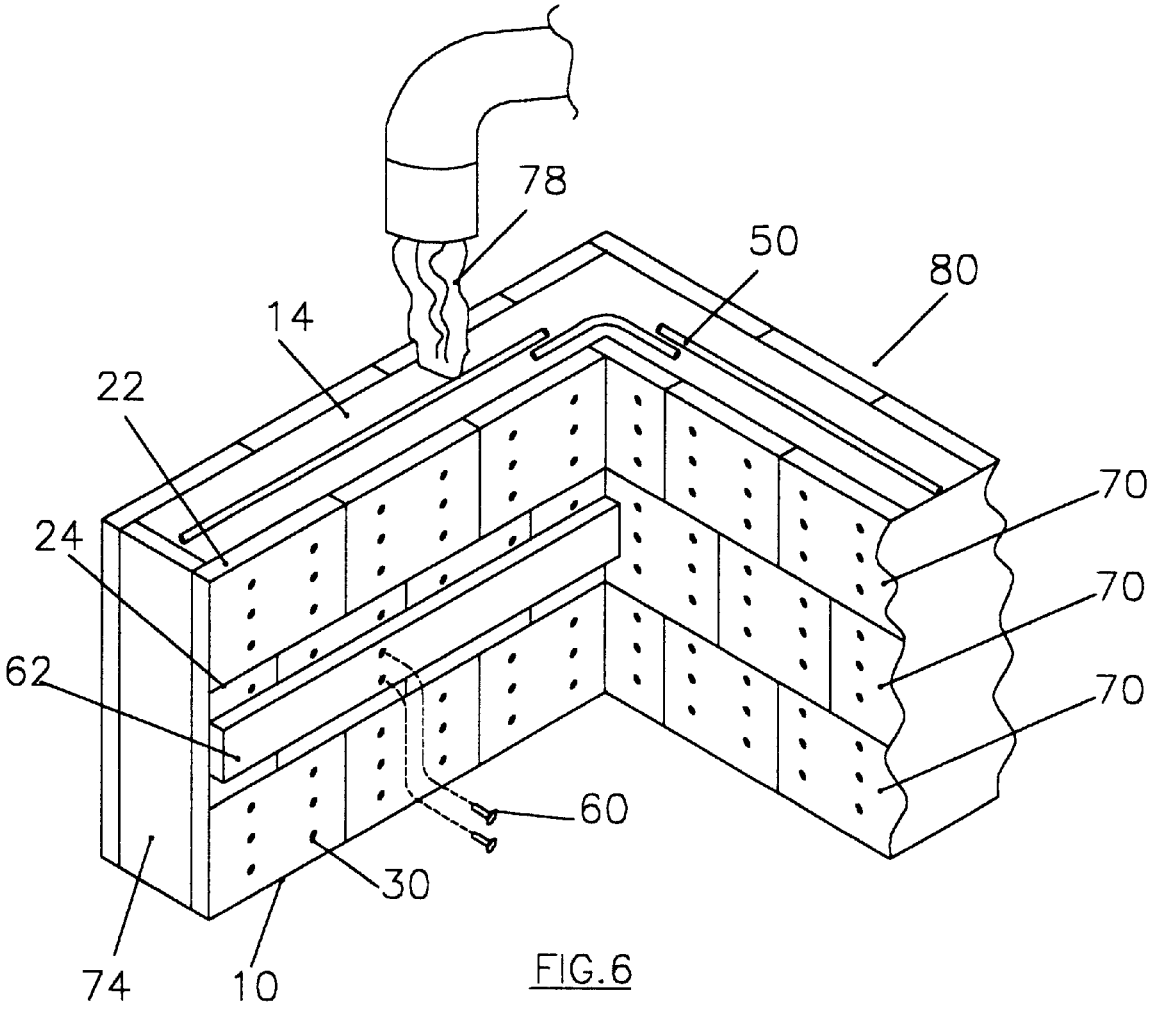
FIG. 6 shows the use of the form to fabricate a wall.
Figure 7:
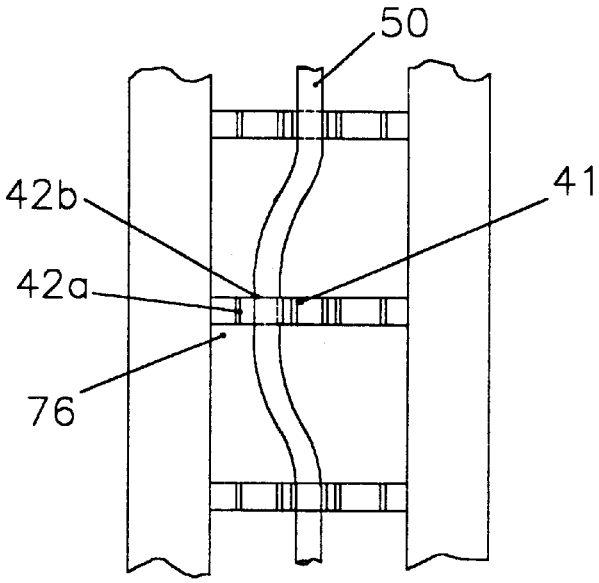
FIG. 7 is a plan view of the positioning of rebar.
Figure 8A:
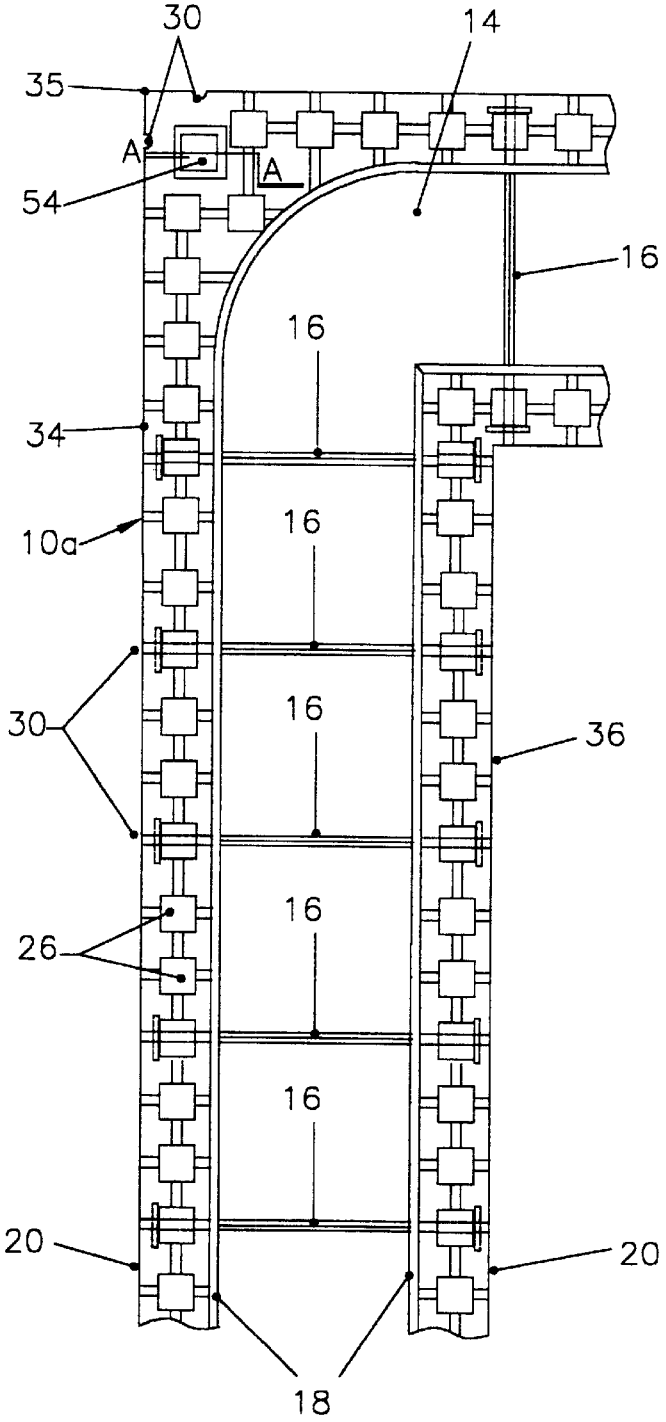
FIG. 8*a* is a view of an insulating concrete form for a 90° corner.

In order to construct a wall 72, as shown in FIG. 6, a plurality of forms 10 are stacked in layers 70, in an overlapping manner. End plates 74 may be used to seal the ends of each of the forms 10 at the exposed end of the wall 72. The interfering projections 26 and recesses 28 enable each layer to be press fit into position. As each layer 70 of the wall 72 is assembled, the rebar 50 is positioned in the receptacles 41 and snap fit into place.

Where the rebar 50 is deformed, as shown at position 76 in FIG. 7, a common result of rebar manufacture and subsequent handling, it interferes with a retainer arm 42*a*. The interfering retainer arm 42*a* may be removed from the web 40 in order to accommodate the irregular shaped rebar 50, without overly increasing the size of a receptacle 41 a in which the rebar 50 is disposed. Excessive enlargement of the receptacle 41 is avoided by the design of the retainer arms 42, wherein each receptacle 41 is defined by two arms 42, rather than one common arm, positioned between adjacent receptacles 42. The resilient nature of the arms 42 permits reinforcing bars 50 of various diameters to be accommodated in the receptacles 41, 41*a*. The relative stiffness of the arms 42 in a direction transverse to the web 40 and the relative flexibility of the spine 43 in that direction provides a hinge 37, or zone of weakness, at the intersection of the arm 42 and the web 40. Repeated flexure in the transverse direction will cause failure along the hinge 37 to facilitate removal of the arm 42.

Referring to FIG. 6, once construction of the wall 72 is completed a charge 78, typically concrete or other suitable building materials, is poured into the interior 14 and allowed to set, thereby producing an insulated structural wall 72. The markings 30 are then used to guide the location of fasteners 60 such as screws or nails used to securely attach a cladding 62 such as drywall or metal siding to the end plates 38 of the tie 16 located in the interior of the panels 12.

The panels 12 are made of a high density foam in order to provide a rigid container to hold the concrete charge 78 in position as it cures, and to supply a layer of insulation to the interior and exterior surfaces once the charge is cured. The ties 16 are made of a low heat transmission material, such as plastic, to inhibit the creation of a thermal bridge between the panels 12. The material of the ties 16 should include a sufficient density and thickness to withstand forces exerted during stacking of the forms 10 and pouring of the concrete charge. All components of the tie 16 are preferably molded as a single unit. The exterior dimensions of the construction form 10 are 9–17 inches wide by 16 inches high by 48 inches long, and the panels 12 themselves are over 2½ inches in thickness. The spacing of the panels 12 are selected so that the thickness of the charged material 78 corresponds to standard block widths, typically 4 inches, 8 inches, or 12 inches although other thickness' can be accommodated if required. The locations of the projections 26 and recesses 28 are interchangeable, and their shapes can either be rectangular, cylindrical, arcuate, square, triangular as well as dissimilar from one another if desired.

In a further embodiment shown in FIG. 8, in which like elements will be identified by like numerals with a suffix added for clarity, an insulating construction form 10*a* serves for the formation of a 90° corner region 35. The form 10*a* comprises an outside panel 34 and an inside panel 36, defining the space 14 into which concrete or other suitable building materials may be charged. In addition to the features of the preferred embodiment, the panel 34 also includes a vertical duct 54 located adjacent to the apex of the corner 35. The duct 54 provides a location to receive an anchor 55 in the interior of the panel 34 for the attachment of the cladding 62 in the corner region 35.

Figure 9:
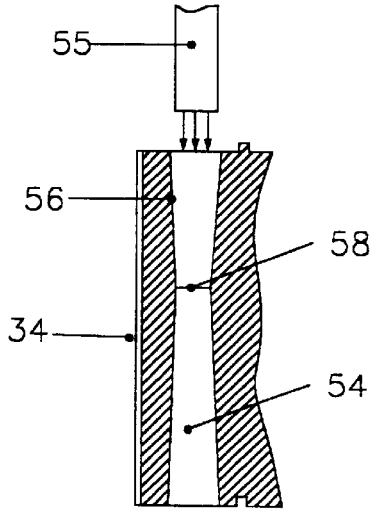
FIG. 9 is a section on the line IX—IX of FIG. 8*a;*

The horizontal cross section of the duct 54 is square, but any other suitably shaped cross section can be used if desired. The vertical cross section of the duct 54, shown in FIGS. 9 and 10, comprises a somewhat symmetrical shaping of inwardly inclined sidewalls 56, which narrow to a converging location 58 to provide a restriction for the rod 55. To provide an anchor for the cladding 62 at the corner region 35 the rod 55, either hollow or solid, is inserted into the duct 54. The inclined orientation of the sidewalls 56 apply a retaining force or restriction to the rod 55 when it is inserted, due to a frictional grip between the sidewalls 56 and rod 55. This frictional grip helps to retain the vertical stacking of individual forms 10*a* in an integral formation during installation and subsequent charging. The rod 55 is selected from a material, typically wood, plastic, or metal that can receive the fasteners 60 used to attach external components on the panel 34. The location of the rod 55 at the apex of the corner 35 provides an additional fastening location at a region where there is no web 40, and therefore enhances the attachment to the panel 34 of strapping, siding, or the like.

In FIGS. 6 and 8, a plurality of markings 30 are situated on the outside surface 18 of panel 34, in order to indicate the interior locations of both the rod 55 and the ties 16. The angle of the corner 35 can vary between 45° and 135°, and the cross-sectional shape of the corner edge 35 can be arcuate, where appropriate.

Figure 10:
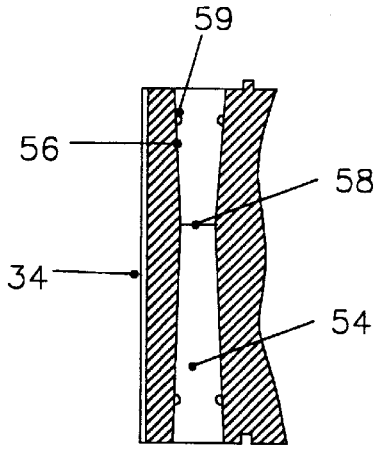
FIG. 10 is a view similar to FIG. 9 of an alternative embodiment.
Figure 8B:
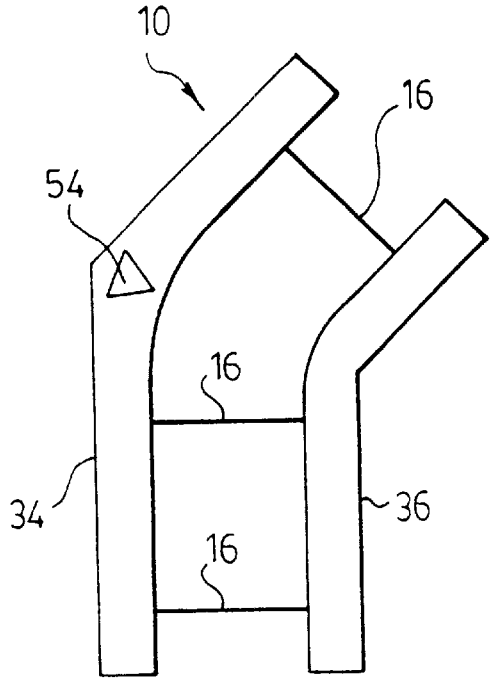
FIG. 8*b* is a view similar to FIG. 8*a* of an alternative embodiment.
Figure 8C:
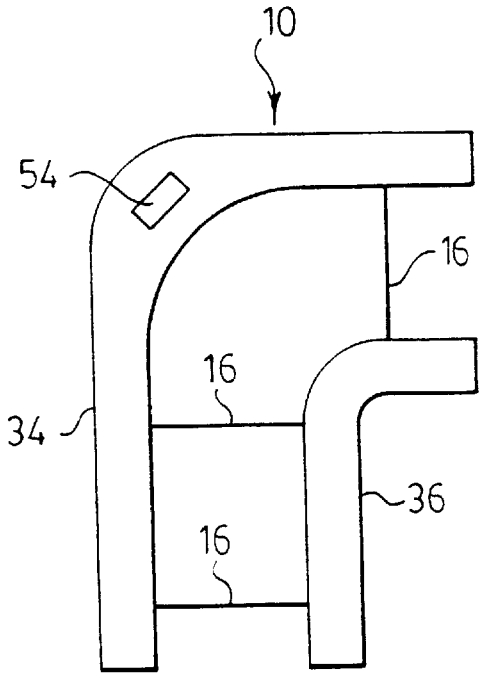
FIG. 8*c* is a view similar to FIG. 8*a* of an alternative embodiment.
Figure 8D:
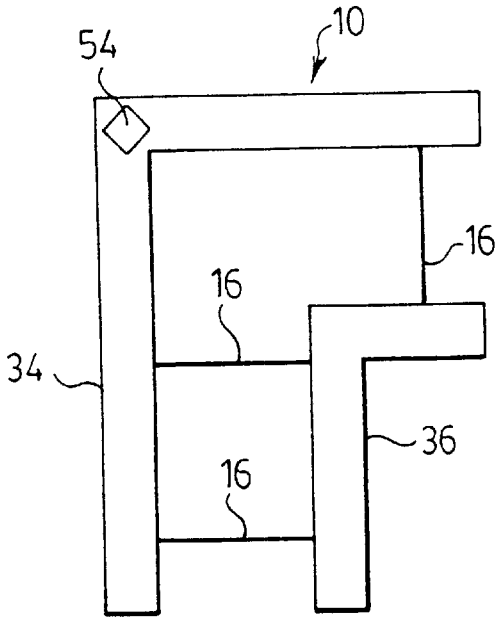
FIG. 8*d* is a view similar to FIG. 8*a* of an alternative embodiment.

Alternatively as shown in FIG. 10, retention of the rod 55 can be by a series of projections 59.

Figure 12:
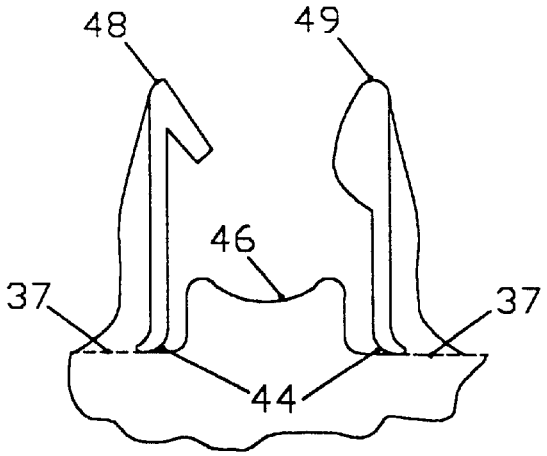
FIG. 12 is an enlarged view of a portion of FIG. 11.
Figure 11:
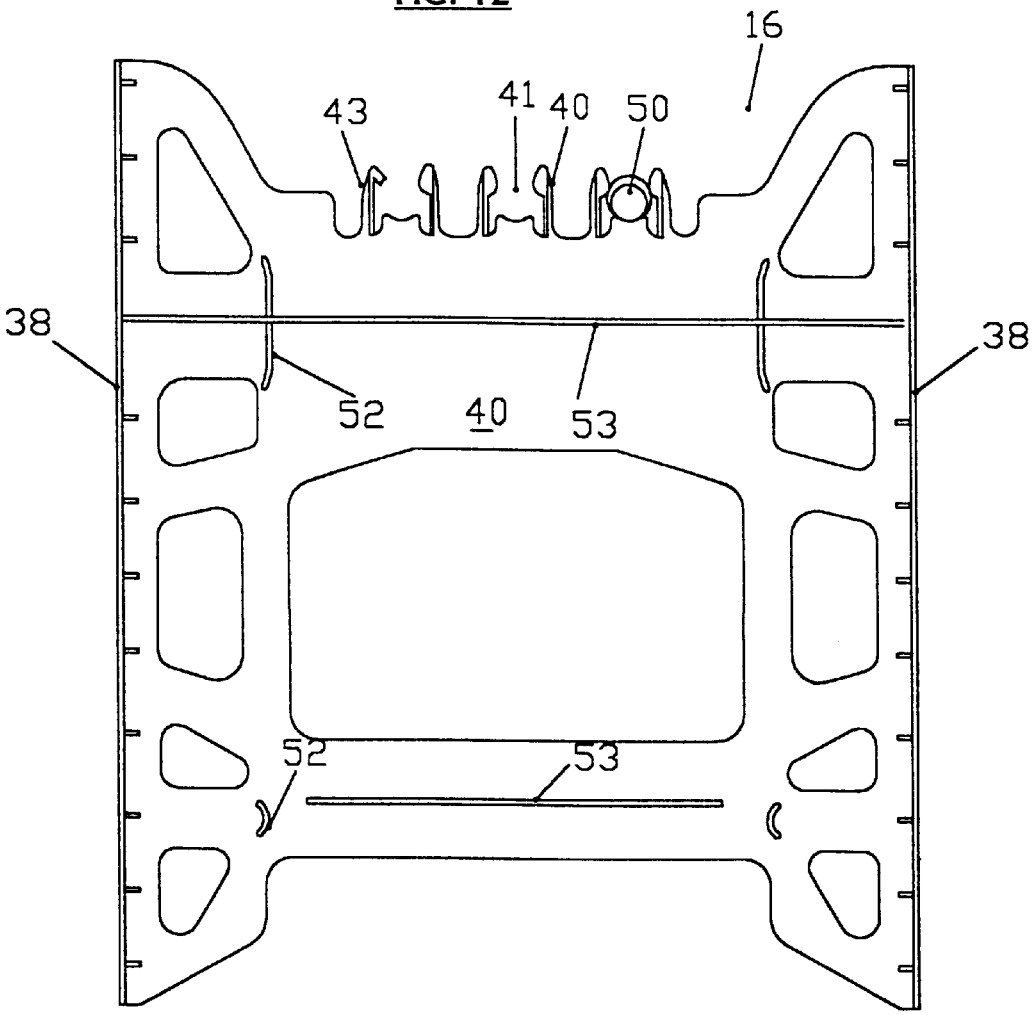
FIG. 11 is a front view of an alternative embodiment of the tie shown in FIG. 5.

An alternative embodiment of the tie 16 is shown in FIG. 11, wherein an arcuate lip 46 is located between the arms 42. This lip 46 projects upward parallel to the web 40 and thereby permits an increase in the length and subsequent resiliency of the arms 42, so as to ease entry of the rebar 50 and engage the outer surface of the rebar 50 when inserted. This design permits larger diameter reinforcing bar 50 to be accommodated in the receptacle 41, as well as providing a tighter snap fit. Weakening notches 44 are located at the hinge 37 in order to facilitate detachment of the arm 42 from the web 40, which can be necessary in the installation of warped rebar 50. An alternative embodiment of an abutment surface 49 is shown on the right hand arm 42 in FIG. 12. The shape of the abutment surface 49 is an arcuate projection disposed inwardly towards the interior of the corresponding receptacle 41.

Figure 14:
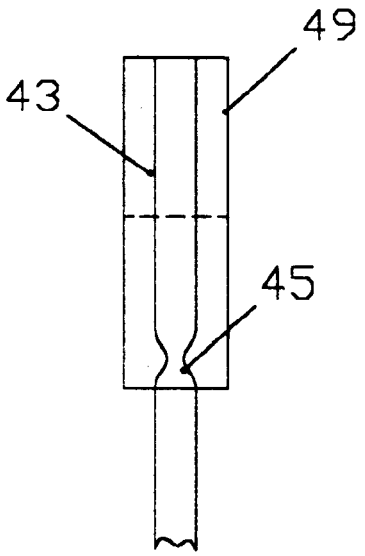
FIG. 14 is a side view of FIG. 13.
Figure 13:
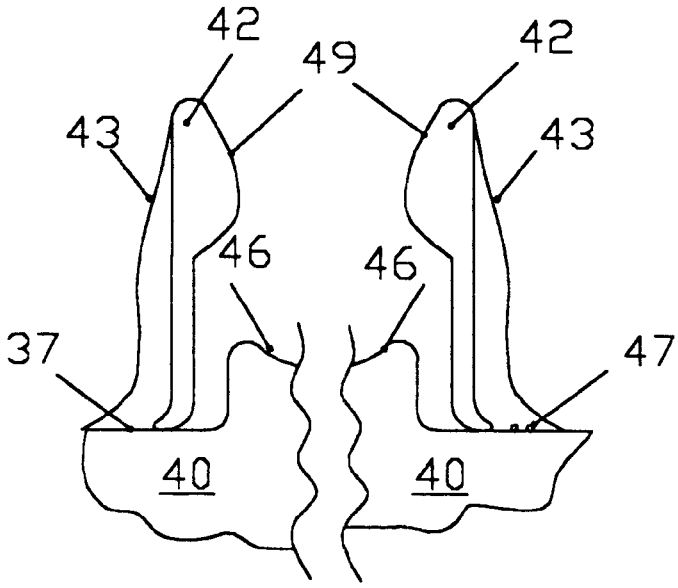
FIG. 13 is an enlarged view similar to FIG. 12 of an alternative embodiment.

In an alternative design of the notch 44, localized thinning 45 of the arms 42 or placement of perforations 47 is shown in FIGS. 13 and 14.

Figure 15:
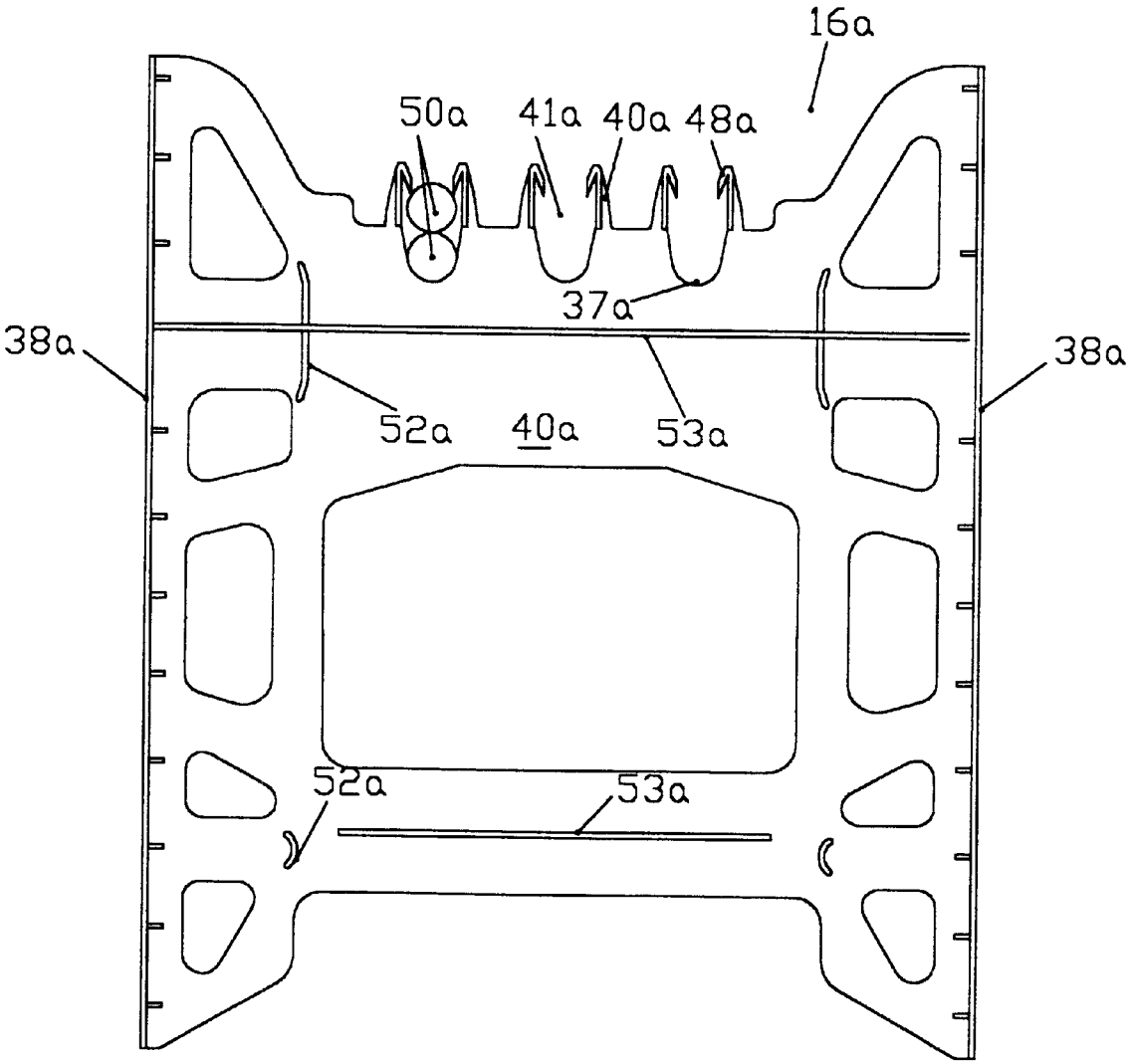
FIG. 15 is a front view of a further embodiment of the tie shown in FIG. 5.

In a further embodiment shown in FIG. 15, the panels 12 include a plurality of openings 64, constructed at the time of manufacture of the insulating construction form 10*b*. The openings 64 are, but not limited to, rectangular in cross-section and may extend through either one or both of the panels 12 if necessary. The openings 64 include a liner 66, made of a suitably rigid material, such as plastic or metal. The openings 64 are dimensioned to correspond to standard dimensional structural members 68 to facilitate installation of a structural member 68, made of materials such as wood or metal, at the construction site.

In an additional embodiment of the opening 64 shown in FIG. 16, anchor bolts 70 are inserted through the opening 64 to permit the fastening of a sill plate 72 against the outside surface 20 of the panel 12. Structural member 68 may then be connected to the sill plate 72.

Although the invention has been described with reference to certain specific embodiments, various modifications thereof will be apparent to those skilled in the art without departing from the spirit and scope of the invention as outlined in the claims appended hereto.

The insulating form as set forth in claim 1 further comprising a plurality of abutment surfaces located on respective ones of said arms projecting toward one another, orientated in such a way so as to provide a snap fit for a reinforcing bar inserted in said receptacle.

I claim:

1. An insulating form comprising a pair of panels made of an insulating material arranged in space parallel relationship with their inner surfaces facing each other and at least two bridging ties extending between and embedded in said panels, each of said panels including an inside surface and an outside surface, a top surface, and a bottom surface, each of said ties comprising a pair of elongated end plates integral with at least one web extending between and connected to said end plates, each of said end plates is located between said inside and said outside surfaces of each of said panels, said web of said ties includes a plurality of adjacent receptacles located along said web, a first receptacle and a second receptacle of the plurality of receptacles are adjacent to one another and each have a discrete pair of retainer arms for locating and retaining a reinforcing bar between either of the pairs of arms, each discrete pair of arms having an inner arm and an outer arm, each of the arms are individually connected to and projecting upwardly from said web such that each of the arms are individually detachable from said web, the first inner arm is positioned adjacent to the second inner arm to inhibit increasing the width of the first receptacle when the first inner arm becomes detached, wherein detachment of the first inner arm permits retaining the rebar between the first outer arm and the second inner arm when positioned there-between.

2. The insulating form as set forth in claim 1 further comprising a plurality of abutment surfaces located on respective ones of said arms projecting toward one another, orientated in such a way so as to provide a snap fit for a reinforcing bar inserted in said receptacle.

3. The insulating form as set forth in claim 2, wherein said abutment surfaces comprise barbs angled inwardly towards an interior of said corresponding receptacle.

4. The insulating form as set forth in claim 2, wherein said abutment surfaces comprise an arcuate projection projecting inwardly towards an interior of said corresponding receptacle.

5. The insulating form as set forth in claim 2 further including a spine integrally formed along a back of each of said arms.

6. The insulating form is set forth in claim 2, wherein at least one of said receptacles includes an arcuate lip projecting upwardly on said top of said web and between said pair of said arms substantially in the plane of said web.

7. The insulating form as set forth in claim 1 further comprising a zone of weakness located adjacent to the connection of the inner arms to said web, said zone of weakness facilitates the detachment of the inner arms from said web through displacement of the arms transverse to a plane of said web.

8. The insulating form as set forth in claim 7, wherein said zone of weakness caused by said hinge is delimited by a notch undercutting the arm adjacent to said web.

9. The insulating form as set forth in claim 1 further including a spine integrally connected to a back of each of said arms, said spine being thinner at its intersection with said web to provide a zone of weakness.

10. The insulating form as set forth in claim 1 further including a spine integrally connected to a back of each of said arms, wherein a plurality of perforations is provided at an intersection between said spine and said web to provide a zone of weakness.

11. The insulating form as set forth in claim 1, wherein said web is substantially planar and a plurality of guides project outwardly from said web to position said tie in a mold during the formation of said panels.

12. The insulating form as set forth in claim 1, wherein said web is substantially planar and a plurality of ridges substantially orthogonal to a side face of said web project outwardly therefrom to stiffen said web.

13. The insulating form as set forth in claim 1, wherein said top and said bottom of said panels include an interconnecting mechanism comprising a plurality of projections and a plurality of corresponding recesses.

14. The insulating form as set forth in claim 13, wherein a height of each of said projections is equal to or less than a depth of each of said recesses.

15. The insulating form as set forth in claim 14, wherein a volume of each of said projections is less than or equal to that of each of said corresponding recesses.

16. The insulating form as set forth in claim 15, wherein the insertion of said projections into said corresponding recesses provides an interference fit between adjacent concrete forms stacked in a vertical manner, in order to inhibit separation of said adjacent concrete forms during installation.

17. The insulating form as set forth in claim 16, wherein said interference fit is provided by each of said projections having a greater width than that of each of said corresponding recesses.

18. The insulating form as set forth in claim 16, wherein each of said projections and each of said recesses is made in said rectangular prism configuration with rounded edges.

19. The insulating form as set forth in claim 16, wherein said projections and said corresponding recesses include shapes which are dissimilar from one another.

20. An insulating form comprising a pair of panels made of an insulating material arranged in a spaced parallel relationship with their inner surfaces facing each other and at least two bridging ties extending between and embedded in said panels, each of said panels including an inside surface and an outside surface, a top surface and a bottom surface, each of said ties comprises a pair of elongated end plates integral with at least one web extending between and connected to said end plates, each of said end plates is located between said inside and said outside surfaces of each of said panels, said top and said bottom of said panels including an interconnecting mechanism comprising a plurality of projections and a plurality of corresponding recesses, at least one of the projections having a dimension greater than that of the corresponding recess, wherein the insertion of the projections into the corresponding recesses provides an interference fit between adjacent concrete forms stacked in a vertical manner in order to inhibit separation of said forms during installation.

21. The insulating form as set forth in claim 20, wherein a height of each of said projections is equal to or less than a depth of each of said recesses.

22. The insulating form as set forth in claim 21, wherein a volume of each of said projections is less than or equal to that of each of said corresponding recesses.

23. The insulating form as set forth in claim 20, wherein each of said projections and each of said recesses is made in said rectangular prism configuration with rounded edges.

24. The insulating form as set forth in claim 20, wherein said projections and said corresponding recesses include shapes which are dissimilar from one another.

25. The insulating form as set forth in claim 20, wherein at least one of said panels includes a first and a second portion disposed at angle to define a corner, an outside surface of said first and said second portions include a plurality of markings aligned with an interior duct that is substantially vertical, whereby the position of said duct is indicated.

26. The insulating form as set forth in claim 25, wherein said markings are in the form of raised projections.

27. The insulating form as set forth in claim 25, wherein said markings are in the form of indentations.

28. An insulating form comprising a pair of panels made of an insulating material arranged in a spaced parallel relationship with their inner surfaces facing each other and at least two bridging ties extending between and embedded in said panels, each of said panels including an inside surface and an outside surface, a top surface and a bottom surface, each of said ties comprises a pair of elongated end plates integral with at least one web extending between and connected to said end plates, wherein each of said end plates is located between said inside and said outside surfaces of each of said panels, wherein said at least one of said panels is divided into a first portion and a second portion disposed at angle to define a corner, said corner has a substantially vertical duct extended between said top and said bottom surfaces, wherein said duct includes at least one restriction for reducing the cross-sectional area of said duct.

29. The insulating form as set forth in claim 28, wherein a cross sectional shape of said duct is square.

30. The insulating form as set forth in claim 28, wherein a cross sectional shape of said duct is rectangular.

31. The insulating form as set forth in claim 28, wherein a cross sectional shape of said duct is triangular.

32. The insulating form as set forth in claim 28, wherein a cross sectional shape of said duct is pentagonal.

33. The insulating form as set forth in claim 28, wherein a rod is inserted into said duct.

34. The insulating form as set forth in claim 33, wherein said rod is made of plastic.

35. The insulating form as set forth in claim 33, wherein said rod is made of metal.

36. The insulating form as set forth in claim 33, wherein said rod is made of wood.

37. The insulating form as set forth in claim 33, wherein said at least one restriction provides a frictional grip between said duct and said rod when inserted therein.

38. The insulating form as set forth in claim 28, wherein said angle formed by said corner region lies in the range of 45° to 135°.

39. The insulating form as set forth in claim 38, wherein said angle is 90°.

40. The insulating form as set forth in claim 38, wherein said angle is 45°.

41. The insulating form as set forth in claim 28, wherein a horizontal cross sectional shape of said corner region is angular.

42. The insulating form as set forth in claim 28, wherein the horizontal cross sectional shape of said corner region is arcuate.

* * * * *